US009470461B2

(12) United States Patent
Merklein et al.

(10) Patent No.: US 9,470,461 B2
(45) Date of Patent: Oct. 18, 2016

(54) HEAT EXCHANGER WITH A TANK REINFORCEMENT MEMBER

(75) Inventors: Brian Merklein, Hartford, WI (US); Gregg D. Olson, Racine, WI (US); Mark Kazikowski, Union Grove, WI (US); Jochen Orso, Reutlingen (DE); Jorg Wille, Leinfelden-Echterdingen (DE); Roy J. Ingold, Racine, WI (US); Joachim Wollmershäuser, Wiernsheim (DE)

(73) Assignee: Modine Manufacturing Company, Racine, WI (US)

( * ) Notice: Subject to any disclaimer, the term of this patent is extended or adjusted under 35 U.S.C. 154(b) by 1223 days.

(21) Appl. No.: 12/738,862

(22) PCT Filed: Nov. 3, 2008

(86) PCT No.: PCT/US2008/012434

§ 371 (c)(1),
(2), (4) Date: Jul. 13, 2010

(87) PCT Pub. No.: WO2009/058395

PCT Pub. Date: May 7, 2009

(65) Prior Publication Data

US 2010/0282449 A1 Nov. 11, 2010

Related U.S. Application Data

(60) Provisional application No. 61/001,438, filed on Nov. 1, 2007.

(51) Int. Cl.
*F28F 9/02* (2006.01)

(52) U.S. Cl.
CPC ..... *F28F 9/0226* (2013.01); *F28F 2225/08* (2013.01)

(58) Field of Classification Search
CPC ..... F28F 9/0229; F28F 9/0226; F28F 9/14; F28F 9/165; F28F 9/0001
USPC ..... 165/171, 173, 906, 175, 81, 153, 96, 165/148, 149
See application file for complete search history.

(56) References Cited

U.S. PATENT DOCUMENTS 1,484,749 A 2/1924 Yeager
3,254,707 A 6/1966 Ferguson (Continued)

FOREIGN PATENT DOCUMENTS

DE 4425238 1/1996
DE 20121112 4/2003

(Continued)

OTHER PUBLICATIONS

Office Action from the State Intellectual Property Office of the People's Republic of China for Application No. 200880114516.1 dated Aug. 25, 2011 (Translation and Original, 10 pages).

(Continued)

*Primary Examiner* — Len Tran
*Assistant Examiner* — Hans Weiland
(74) *Attorney, Agent, or Firm* — Michael Best & Friedrich LLP

(57) ABSTRACT

A heat exchanger having a collection tank having an internal chamber and a header connected to the collection tank and receiving a number of flat tubes through apertures in the header. A reinforcing member received within the collection tank and/or the header functions to reinforce the header and/or the collection tank in applications where these elements are subject to internal pressures that would otherwise deform the header and/or collection tank to an unacceptable extent. The heat exchanger may include a curved gasket on each flat tube to match the shape of the flat tubes and a curved header. Also, another gasket can be located between a metal or plastic collection tank and a plastic or metal header, respectively, to prevent leakage therebetween.

8 Claims, 14 Drawing Sheets

(56) References Cited

U.S. PATENT DOCUMENTS

| | | | | |
|---|---|---|---|---|
| 3,622,037 | A * | 11/1971 | Gildart | 220/643 |
| 4,531,578 | A * | 7/1985 | Stay et al. | 165/175 |
| 4,600,051 | A | 7/1986 | Wehrman | |
| 4,730,668 | A | 3/1988 | LeMaster | |
| 5,036,914 | A | 8/1991 | Nishishita et al. | |
| 5,069,277 | A | 12/1991 | Nakamura et al. | |
| 5,107,926 | A | 4/1992 | Calleson | |
| 5,152,339 | A | 10/1992 | Calleson | |
| 5,174,372 | A | 12/1992 | Potier et al. | |
| 5,214,848 | A | 6/1993 | Lelievre | |
| 5,246,065 | A | 9/1993 | Huff | |
| 5,299,636 | A | 4/1994 | Potier | |
| 5,301,748 | A | 4/1994 | Potier | |
| 5,307,870 | A | 5/1994 | Kamiya et al. | |
| 5,351,751 | A | 10/1994 | Cage et al. | |
| 5,355,944 | A * | 10/1994 | Potier | 165/149 |
| 5,415,223 | A | 5/1995 | Reavis et al. | |
| 5,450,896 | A | 9/1995 | Bertva et al. | |
| 5,538,079 | A | 7/1996 | Pawlick | |
| 5,664,625 | A | 9/1997 | Letrange et al. | |
| 5,743,329 | A | 4/1998 | Damsohn et al. | |
| 5,758,721 | A | 6/1998 | Letrange et al. | |
| 5,816,316 | A | 10/1998 | Hoffnung | |
| 5,896,923 | A | 4/1999 | Baba | |
| 5,979,546 | A * | 11/1999 | Stolarski et al. | 165/173 |
| 6,196,305 | B1 * | 3/2001 | Geiger | 165/173 |
| 6,247,232 | B1 | 6/2001 | Lambert et al. | |
| 6,296,051 | B1 * | 10/2001 | Sahnoun et al. | 165/173 |
| 6,427,769 | B2 | 8/2002 | Horie et al. | |
| 6,460,610 | B2 | 10/2002 | Lambert et al. | |
| 6,604,574 | B1 | 8/2003 | Loomis et al. | |
| 6,896,044 | B2 | 5/2005 | Kato | |
| 6,938,675 | B2 | 9/2005 | Kokubunji et al. | |
| 6,988,544 | B2 | 1/2006 | Ozaki et al. | |
| 7,058,576 | B2 | 6/2006 | Miyazawa et al. | |
| 7,089,998 | B2 | 8/2006 | Crook | |
| 7,210,520 | B2 | 5/2007 | Yamanaka et al. | |
| 7,237,605 | B2 | 7/2007 | Ozaki | |
| 7,255,158 | B2 | 8/2007 | Ozaki | |
| 7,303,003 | B2 | 12/2007 | Ohhashi et al. | |
| 7,341,098 | B2 | 3/2008 | Brost et al. | |
| 2002/0023734 | A1 * | 2/2002 | Wagner | 165/81 |
| 2002/0162648 | A1 * | 11/2002 | Crook | 165/153 |
| 2005/0133208 | A1 * | 6/2005 | Powers et al. | 165/149 |
| 2005/0194119 | A1 * | 9/2005 | Yamanaka et al. | 165/67 |
| 2006/0061044 | A1 * | 3/2006 | Merklein et al. | 277/510 |
| 2006/0213651 | A1 | 9/2006 | Higashiyama et al. | |
| 2007/0044949 | A1 | 3/2007 | Ohashi | |
| 2007/0051504 | A1 | 3/2007 | Ohashi | |
| 2008/0136123 | A1 * | 6/2008 | Angot et al. | 277/650 |
| 2010/0282449 | A1 | 11/2010 | Merklein et al. | |
| 2011/0088886 | A1 | 4/2011 | Kalbacher et al. | |

FOREIGN PATENT DOCUMENTS

| | | |
|---|---|---|
| DE | 20307881 | 9/2004 |
| FR | 2614980 | 11/1988 |
| JP | 03-158698 | 7/1991 |
| JP | 2006-098048 | 4/2006 |
| WO | 2006005449 | 1/2006 |
| WO | 2006077044 | 7/2006 |
| WO | 2007028463 | 3/2007 |
| WO | 2009058395 | 5/2009 |

OTHER PUBLICATIONS

PCT/US2008/012434 International Search Report and Written Opinion dated Jul. 8, 2009 (7 pages).

PCT/US2008/012434 International Preliminary Report on Patentability dated May 4, 2010 (5 pages).

* cited by examiner

HEAT EXCHANGER WITH A TANK REINFORCEMENT MEMBER

CROSS-REFERENCE TO RELATED APPLICATIONS

The present application claims the benefit of Provisional Application Ser. No. 61/001,438, filed Nov. 1, 2007, the entire content of which is hereby incorporated by reference.

BACKGROUND

A variety of heat exchangers exist in which a number of tubes are connected to and in fluid communication with a collection tank for introducing and/or removing fluid from the flat tubes. In many cases, the applications of such heat exchangers result in high pressure and thermal stresses, such as in locations at and adjacent to the connections of the flat tubes to the collection tank. Also, it is desirable for such collection tanks and the connections of the flat tubes thereto to withstand significant pressure without excessive deformation or damage—despite the desire to construct collection tanks from increasingly thinner and lighter materials. Particularly in cases in which the collection tanks are constructed of multiple parts (e.g., a header plate and a structure defining the remainder of the collection tank), this capability should extend to the interface between the collection tank parts.

Further design issues for many heat exchangers relate to the use of gaskets between heat exchanger components, such as tube-to-header plate gaskets, gaskets located between header plates and other collection tank components, and the like. Such gaskets must perform their hydraulic or pneumatic sealing functions while being exposed in some applications to high pressures and/or temperatures, material expansion and contraction, and other challenges. Reliable gaskets and gasket retention continue to be elusive in many applications.

Accordingly, it will be appreciated that heat exchangers having collection tanks and collection tank-to-flat tube joints adapted to withstand thermal and/or pressure stresses and cycling are welcome additions to the industry, as are reliable heat exchanger gaskets and gasket retention designs, and heat exchangers that are relatively light weight and that can be produced more efficiently and at a lower cost.

SUMMARY

Some embodiments of the present invention provide a header for a collection tank of a heat exchanger. The header can provide an increased level of strength to the heat exchanger and to connections between the header and tubes connected thereto. The header can have a convex shape configured to reduce thermal mechanical stresses at tube-to-header joints, and to reduce pressure stresses.

In some embodiments, the header of the collection tank is manufactured from plastic, and is curved about a longitudinal axis of the collection tank, thereby presenting a generally convex shape toward the tubes connected thereto, and a generally concave shape toward an interior of the collection tank. The tubes can have any cross-section shape desired. However, unique advantages can be achieved by the use of flat tubes (i.e., tubes having opposing substantially broad flat sides joined by opposing narrow sides) connected to the header.

By virtue of a curved header as described above, plastic headers can withstand internal collection tank pressures that could otherwise generate significant header deformation. Under pressure loading of the curved plastic header described above, there is a considerably reduced degree of header deformation. In some embodiments, such deformation can even be eliminated. As a result, the mechanical load experienced by connections between the header and tubes fastened thereto is considerably reduced.

Additionally, by virtue of the curved plastic header as described above, it is possible in some embodiments to achieve increased strength of the header and of the connections between the header and tubes. Since the strength of the header and the tube-to-header connections often decreases from the periphery of the header toward the center of the header, the above-described header curvature in a central region of the header significantly increases the strength of the header in the central region. As a result of the increased strength, it is possible to achieve weight and cost savings by reduction of the thickness of the material from which the header and/or tubes is constructed. The increased mechanical strength also increases the service life of a collection tank and heat exchanger having such a header. Such advantages do not necessarily require any additional expenditure with regard to the header and collection tank material, the number of header and collection tank components, and the individual production stages of the header and collection tank. Also, reproducible and permanently sealed connections between the header and individual tubes are possible using the curved header described above and relatively low production tolerances.

Other aspects of the present invention relate to manners in which a header can be connected to the rest of a collection tank while retaining a gasket or other seal in position with respect to such parts, manners in which to provide a seal at the interfaces between the tubes and header of a heat exchanger, and manners in which the collection tank and portions of the collection tank and header interface can be reinforced to increase the pressure capacity of the collection tank and/or to enable the use of thinner and different collection tank materials.

In some embodiments, a heat exchanger is provided, and comprises a plurality of tubes each having opposing broad and substantially flat sides joined by two opposing narrow sides; a header having a plurality of apertures each dimensioned to receive a corresponding tube of the plurality of tubes; a collection tank coupled to the header and having an internal chamber in fluid communication with the plurality of tubes; a gasket located between the collection tank and the header; and at least one reinforcement extending across the internal chamber.

Some embodiments of the present invention provide a heat exchanger, comprising a plurality of tubes each having opposing broad and substantially flat sides joined by two opposing narrow sides; a plastic collection tank having an internal chamber in fluid communication with the plurality of tubes; a metal header coupled to the plastic collection tank and having a plurality of apertures each dimensioned to receive a corresponding tube of the plurality of tubes, the metal header elongated in a longitudinal direction and curved about a longitudinal axis of the metal header to present a concave shape to the internal chamber and a convex shape away from the internal chamber; a gasket at least partially separating the metal header from the plastic collection tank and sealing a gap between the metal header and the plastic collection tank; and a reinforcement extending across the internal chamber and at least partially retaining the gasket in position between the metal header and the plastic collection tank.

In some embodiments, a heat exchanger is provided, and comprises a plurality of tubes each having opposing broad and substantially flat sides joined by two opposing narrow sides; a collection tank having an internal chamber in fluid communication with the plurality of tubes; a header coupled to the collection tank and having a plurality of apertures each dimensioned to receive a corresponding tube of the plurality of tubes, the header elongated in a longitudinal direction and curved about a longitudinal axis of the header to present a concave shape to the internal chamber and a convex shape away from the internal chamber; and a gasket received on a tube of the plurality of tubes and curved about the longitudinal axis of the header.

Still other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

FIGS. 1-5B illustrate a collection tank assembly header 110 adapted for a collection tank of a heat exchanger 124. The heat exchanger 124 is suitable for any application in which heat exchange takes place with fluid passing through the collection tank. Such applications exist in vehicle systems, such as those used in conjunction with internal combustion engines. In some applications for example, the heat exchanger 124 can function as a cooler, as a condenser, or as an evaporator. Also, in some applications, the heat exchanger 124 can be connected to exchange heat in a refrigerant circuit.

Figure 7:
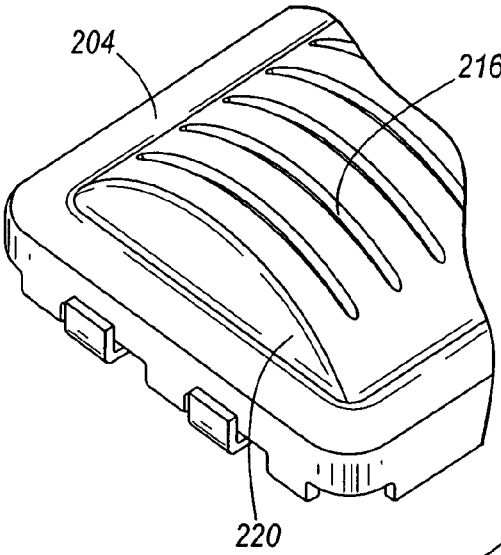
FIG. 7 is a top perspective view of a header according to an embodiment of the present invention.
Figure 8:
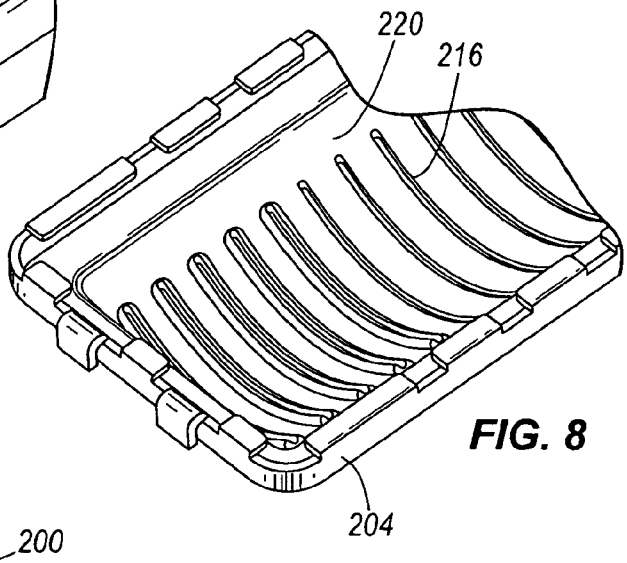
FIG. 8 is a bottom perspective view of the header shown in FIG. 7.
Figure 9:
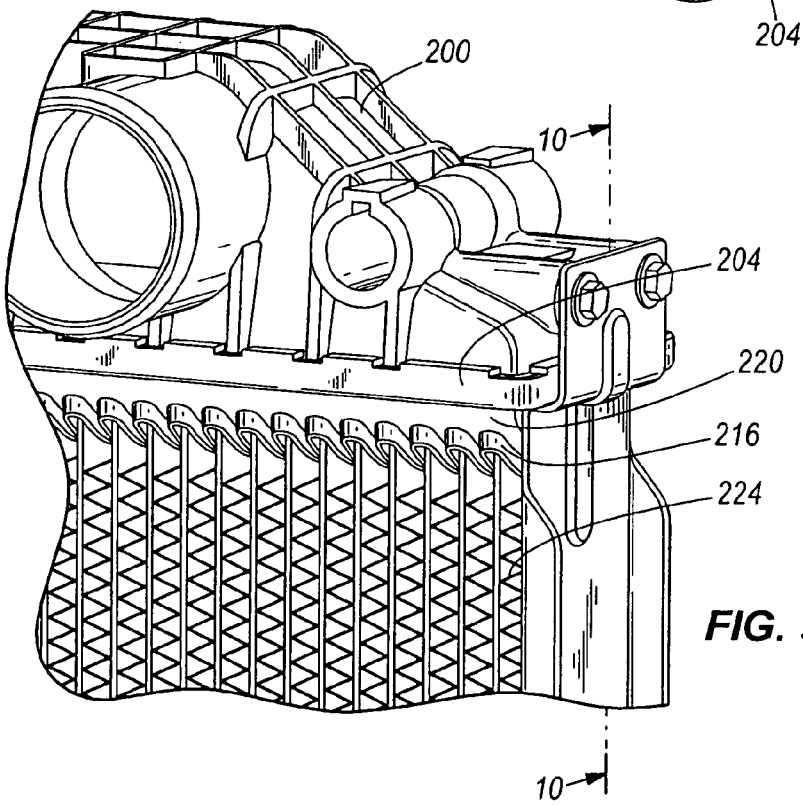
FIG. 9 is a perspective view of part of a heat exchanger according to another embodiment of the present invention.
Figure 10:
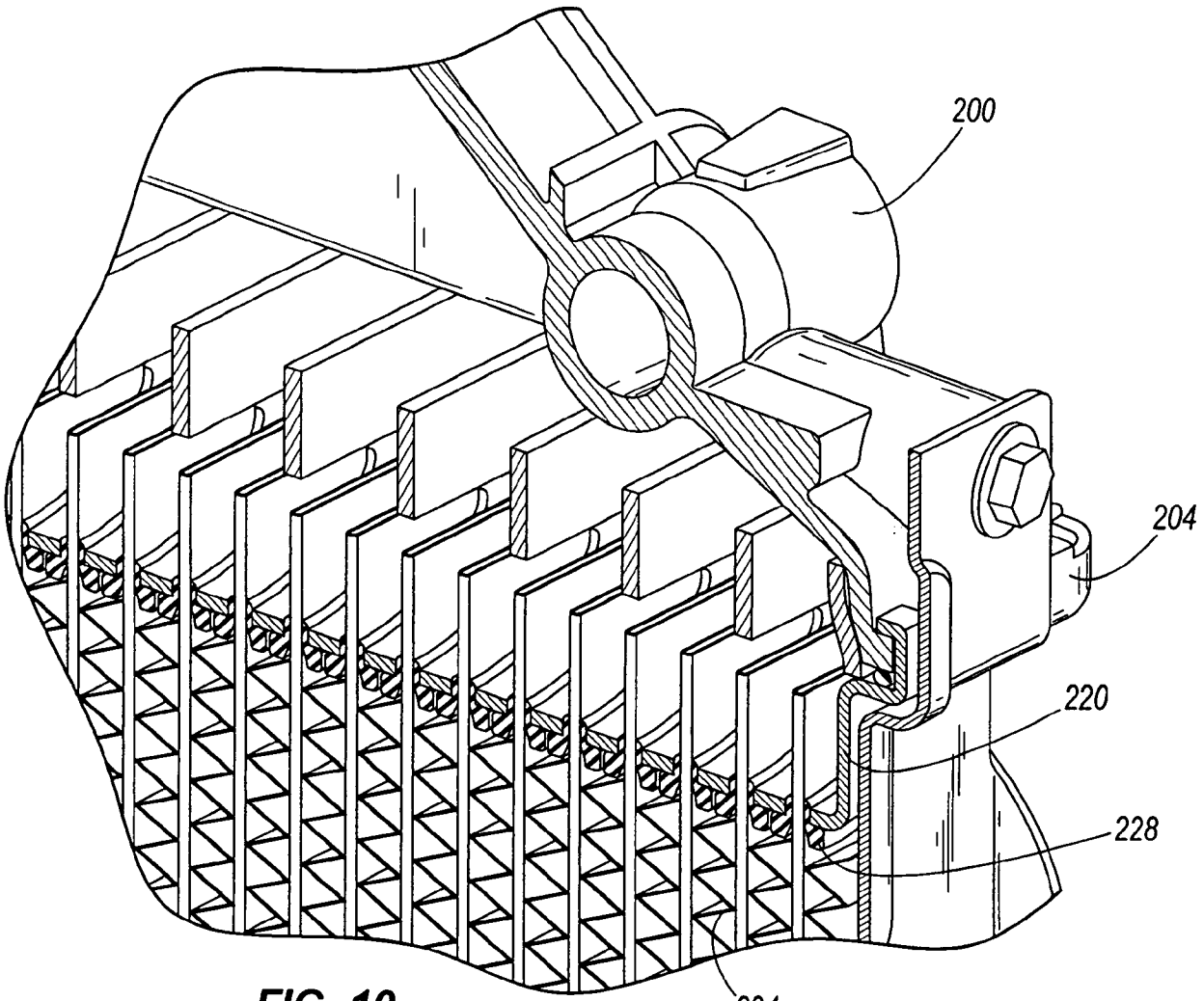
FIG. 10 is a cross-sectional perspective view of the heat exchanger shown in FIG. 9, taken along line 10-10 of FIG. 9.
Figure 11:
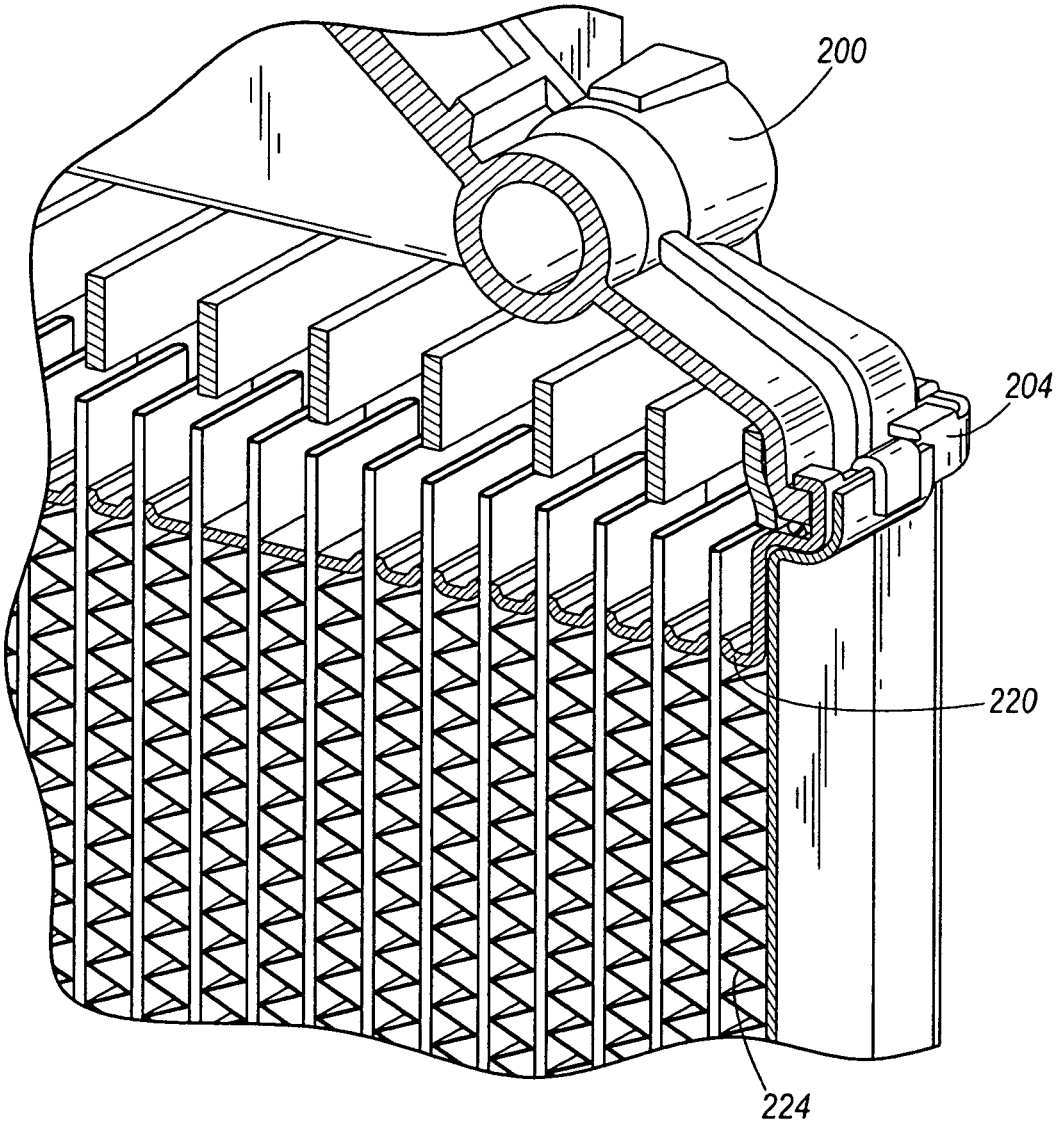
FIG. 11 is a cross-sectional perspective view of a heat exchanger according to another embodiment of the present invention.

The collection tank assembly 110 illustrated in FIGS. 1-5B includes a collection tank 100 (only part of which is shown in FIGS. 1-5B), a tank reinforcement member 104, and a gasket 108. The illustrated collection tank 100 is constructed of a first portion 100A at least partially defining an enclosure through which fluid flows, and another portion (not shown in FIGS. 1-5B) called a header. The header connects with the first portion 100A of the collection tank 100 to substantially enclose an internal chamber of the collection tank 100. An example of a header 204 that can be used in conjunction with the first collection tank portion 100A is shown in FIGS. 7 and 8, and will be described in greater detail below.

In some embodiments, the first portion 100A of the collection tank 100 is made of aluminum, steel, iron, or other metal, whereas the header (e.g., header 104) is made of plastic. Although this material combination provides unique performance results (including a thin-walled but strong first portion 100A able to withstand significant pressures while permitting the use of a less expensive and/or easy to manufacture plastic header), other materials and material combinations are possible. For example, in other embodiments, both the first portion 100A and the header are made of plastic. As another example, in other embodiments, both the first portion 100A and the header are made of metal. Alternatively, in still other embodiments, the first portion 100A is made of plastic, while the header is made of metal.

The first portion 100A of the collection tank 100 can be secured to the header (e.g., header 204 shown in FIGS. 7 and 8) in a number of different manners, some of which provide a degree of resistance to fluid leakage under internal collection tank pressures. To this end, peripheral edges of the first portion 100A can abut peripheral edges of the header, such as the planar peripheral edges of the header 204 shown in FIGS. 7 and 8. The first portion 100A and the header can be secured in these and other locations by welding, soldering, brazing, and the like.

To prevent leakage of fluid out of the collection tank 100, a gasket 108 is located between the first portion 100A of the collection tank 100 and the header. The illustrated gasket 108 extends about the periphery of the first portion 100A and the header, and can be made of rubber, plastic, or any other material suitable for forming a seal.

As mentioned above, the collection tank assembly 110 shown in FIG. 105B also includes a tank reinforcement member 104 to help retain the gasket 108 in a position with respect to the first portion 100A of the collection tank 100 and the header in which fluid is prevented from exiting the collection tank 100 during operation of the heat exchanger 124. The reinforcement member 104 shown in FIG. 7 is plastic, and can be manufactured by injection molding. Alternatively, the reinforcement member can be made of any other suitable material (including without limitation aluminum, steel, iron, and other metals, composite materials, and the like), and can be manufactured in any other suitable manner (including without limitation casting, stamping, pressing, deep drawing, extruding, machining, and the like).

The tank reinforcement member 104 illustrated in FIGS. 1-3, 5A, and 5B includes interlock apertures 112 configured to receive the gasket 108. The apertures 112 can be dimensioned to receive and retain portions of the gasket 108 by an interference fit. The illustrated tank reinforcement member 104 further includes cross-webs 116, which provide further support to the tank reinforcement member 104. The cross-webs 116 enable the collection tank assembly 110 to withstand greater internal pressures, and can enable the collection tank assembly 110 to withstand loads experienced by a header being crimped to the collection tank 100.

The illustrated gasket 108 includes gasket cross-webs 120 configured to provide additional support to the gasket 108. In some embodiments, the cross-webs 120 extend across the internal chamber of the collection tank 100. In some embodiments, the gasket 108 further includes positioning shoulders 124 which guide placement of the gasket 108 within the interlock slots 112 (e.g., insuring that the cross-webs 120 are positioned properly within the collection tank 100 upon installation of the gasket 108 and/or maintaining a peripheral portion of the gasket 108 in proper position within a seat 111 defined by the tank reinforcement member 104).

In operation, the tank reinforcement member 104 can be placed in the collection tank 100 immediately after the collection tank 100 is molded. Alternatively, the tank reinforcement member 104 can be placed in the collection tank 100 any time prior to usage. The collection tank 100 can be shaped and dimensioned to receive the tank reinforcement member 104 by a clearance fit, snap fit, press fit, or in any other mating manner. For example, the tank reinforcement member 104 illustrated in FIGS. 1-3, 5A, and 5B mate with the collection tank 100 via multiple projection and aperture sets. This mating relationship can enable the projections and apertures to slide with respect to one another until reaching a limit of movement (e.g., a bottom of each aperture), thereby defining a positive stop for accurate placement of the tank reinforcement member 104 with respect to the collection tank 100. Accurate placement of the tank reinforcement member 104 can allow for proper gasket placement and compression without contact or interference with the heat exchanger header. A locking feature or a heat staking operation can be used to provide further support and retain the tank reinforcement member 104 within the collection tank 100.

By virtue of the relationship between the gasket 108 and the tank reinforcement member 104 described above with regard to some embodiments of the present invention, the gasket 108 can be installed on the tank reinforcement member 104 (e.g., by pressing cross-webs 116 or other portions of the gasket 108 into apertures 112 in the tank reinforcement member 104), and the tank reinforcement member 104 and gasket 108 can be moved or otherwise manipulated by a user or machine for installation in the collection tank 100. In those embodiments in which there is an interference fit of the gasket 108 with the tank reinforcement member 104 (e.g., within the apertures 112 described above), this movement or manipulation can even place the tank reinforcement member and gasket assembly in an inverted position.

In light of the relationship between the gasket 108 and the tank reinforcement member 104 described above, assembly of a resulting heat exchanger can be simplified and improved. Also, the gasket 108 can be retained in proper position with respect to the collection tank 100 and header throughout the life of the heat exchanger.

Although a separate tank reinforcement member 104 as described above is desirable in many applications, it should be noted that the tank reinforcement member 104 and any of the gasket retention features described above can instead be integral with the collection tank 100 (e.g., molded as part of the collection tank 100) in other embodiments.

FIGS. 6A-6I illustrate collection tank assemblies 210 with tank reinforcement members 203 according to other embodiments of the present invention. Like the illustrated embodiment of FIGS. 1-5B above, the collection tank assemblies 210 illustrated in FIGS. 6A-6I each have a collection tank 200 comprising a first collection tank portion 200A and a header 204, a tank reinforcement member 203, and a gasket 208. The illustrated collection tank assemblies 210 are well-suited, for example, to radiator and charge air cooler applications utilizing brazed or grommeted tube-to-header joints. As also provided in the embodiment of FIGS. 1-5B (but not shown therein), the header 204 can be attached to flat tubes received within slot-shaped openings 216 in the header 204. The tubes can be fastened to and within the header 204 in a pressure-tight manner by soldering, welding, adhesive or cohesive bonding material, or in any other suitable manner.

With reference to the embodiments of FIGS. 6A-6F and 6H-6I, headers 204 illustrated therein have a generally curved central portion 220 and a peripheral shoulder 222 extending laterally therefrom. The curved central portion 220 presents a convex shape to the tubes and a concave shape to the interior of the collection tank 200. The design of the illustrated header 204 provides an increase in strength of the header 204 and provides an increase in strength of the connections between the header 204 and tubes (not shown) by stiffening the header 204 near the tube-to-header joints. Also, the curved central portion 220 reduces pressure stresses in both the header gasket well 221 (i.e., the location in which the gasket 208 is retained) and in the tube noses. Therefore, it is possible to reduce the cross-sectional thickness of the individual components of the collection tank assembly 210 to achieve weight and cost savings. As a result of the increase in the mechanical strength of the header 204 (and more generally, of the collection tank assembly 210), the service life of the collection tank assembly 210 and of a correspondingly configured heat exchanger is increased without any additional material expenditures, heat exchanger components, or individual production steps.

Also by virtue of the curved shape of the central header portion 220 described above and illustrated in FIGS. 6A-6F, and 6H-8, deformation of the header 204 is anticipated. It will be appreciated that under moderate collection tank pressures, deformation of a header 204 having no curvature is likely. However, due to the curved central portion 220 of the header 204, when the curved central portion 220 of the header 204 is under pressure loading, the header 204 experiences a considerably reduced degree of deformation. As a result, mechanical load on the connections between inserted tubes and the header are reduced, and bending stress upon the header 204 (e.g., due to internal pressures of the collection tank 200) are converted into tensile stresses, thereby providing increased strength of the header 204 and the header-to-tube connections. Since the strength of the header 204 and/or of the header-to-tube connections can decrease toward the center of the header 204 in many embodiments, the curvature of the central portion 220 of the header 204 increases the strength of the header 204 in the center of the header 204.

With continued reference to the illustrated header embodiments of FIGS. 6A-6F and 6H-8, the header 204 also has a substantially flat peripheral shoulder 222 which can extend about the entire periphery of the curved central portion 220. This shoulder 222 can at least partially define a gasket well 221 (mentioned above) in which a gasket 208 between the header 204 and first collection tank portion 200A is retained in any of the manners described above.

In some embodiments, the header 204 of the collection tank 200 is manufactured from plastic, and is curved about a longitudinal axis of the collection tank 200, thereby presenting a generally convex shape toward the tubes connected thereto, and a generally concave shape toward an interior of the collection tank 200. In other embodiments, other header materials can instead be used as desired. Also, any of the material combinations described above in connection with the embodiment of FIGS. 1-5B are applicable in connection with FIGS. 6A-6I.

The tubes for connection to the headers 204 shown in FIGS. 6A-6I can have any cross-section shape desired. However, unique advantages can be achieved by the use of flat tubes (i.e., tubes having opposing substantially broad flat sides joined by opposing narrow sides) connected to the header 204.

The collection tank assemblies 210 illustrated in FIGS. 6A-6F and 6H-8 each have a tank reinforcement member 203. The tank reinforcement member 203 can be substantially flat as shown in FIGS. 6A-6F and 6H-8, and can have any number of reinforcing webs 212 extending across the interior of the collection tank 200 in longitudinal or lateral directions (thereby increasing the strength of the collection tank 200) without obstructing or significantly obstructing flow through the collection tank 200 to or from the tubes connected to the collection tank 200. The tank reinforcement member 203 can be connected to the collection tank 200 in any of the manners described above. For example, in some embodiments, slots in the tank reinforcement member 203 accept collection tank features with a snap-fit, press-fit, or other mating engagement when the collection tank 200 is installed upon a core of a heat exchanger. As shown in FIGS. 6A-6F and 6H-6I, in some embodiments the tank reinforcement member 203 is received within and/or lies upon the header 204. In some embodiments, the tank reinforcement member 203 lies within and/or upon the shoulder 222 of the header 204, and can extend beneath, below, or beside the gasket 208. The tank reinforcement member 203 can increase the material thickness of the collection tank assembly 210 (e.g., doubling the thickness of the gasket well area 221, for example), such as in an area of the collection tank 200 adjacent the gasket 208. Also, the tank reinforcement member 203 can strengthen the collection tank 200 in various ways, such as by extending the capability of tank-to-header crimp joints in high-pressure applications.

In some embodiments, the tank reinforcement member 203 can be assembled with the header 204 prior to or during core assembly. The tank reinforcement member 203 can be connected to the header 204, for example, in any manner desired, including without limitation by brazing or welding, by Tox® rivets (Tox Pressotechnik GmbH & Co. KG), or in any other manner desired. For example, a complete braze joint between the header 204 and tank reinforcement member 203 can be used in those embodiments in which the tank reinforcement member 203 at least partially defines a sealing surface for the gasket 208.

Figure 1:
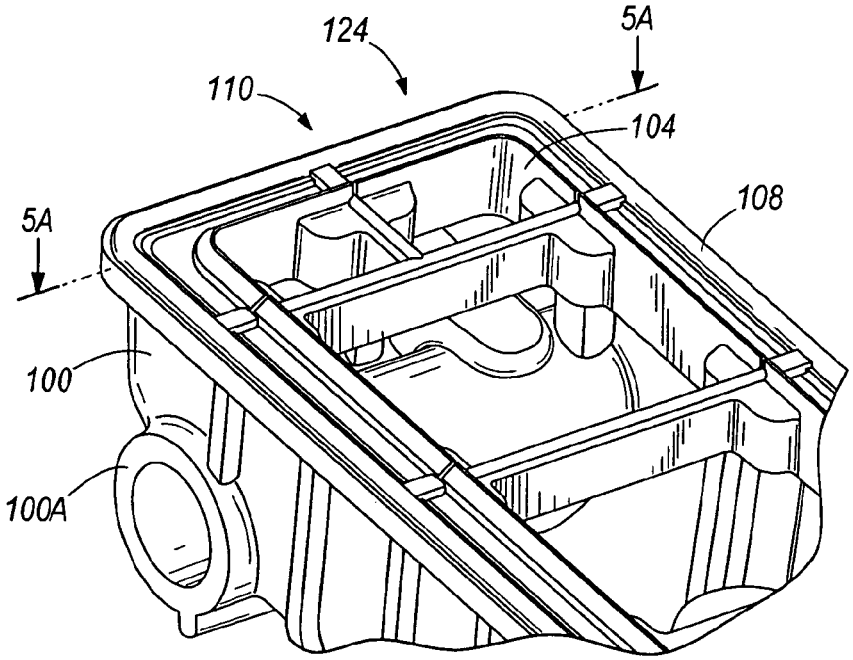
FIG. 1 is a perspective view of a collection tank having a tank reinforcement member according to an embodiment of the present invention.
Figure 2:
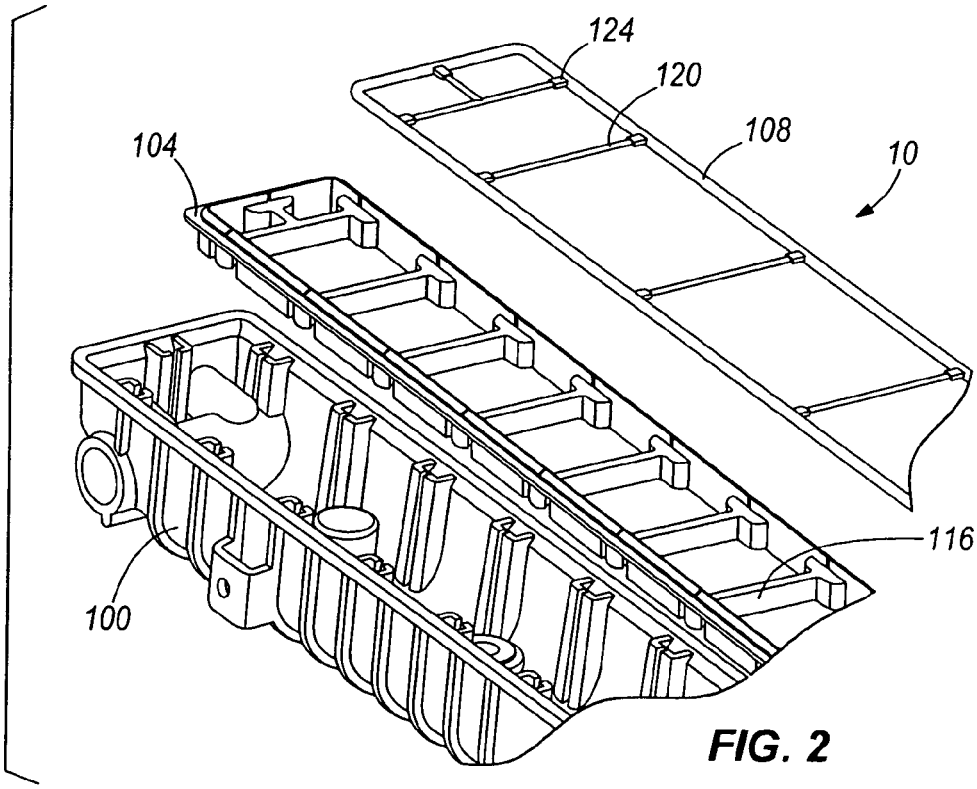
FIG. 2 is an exploded view of the collection tank shown in FIG. 1.
Figure 3:
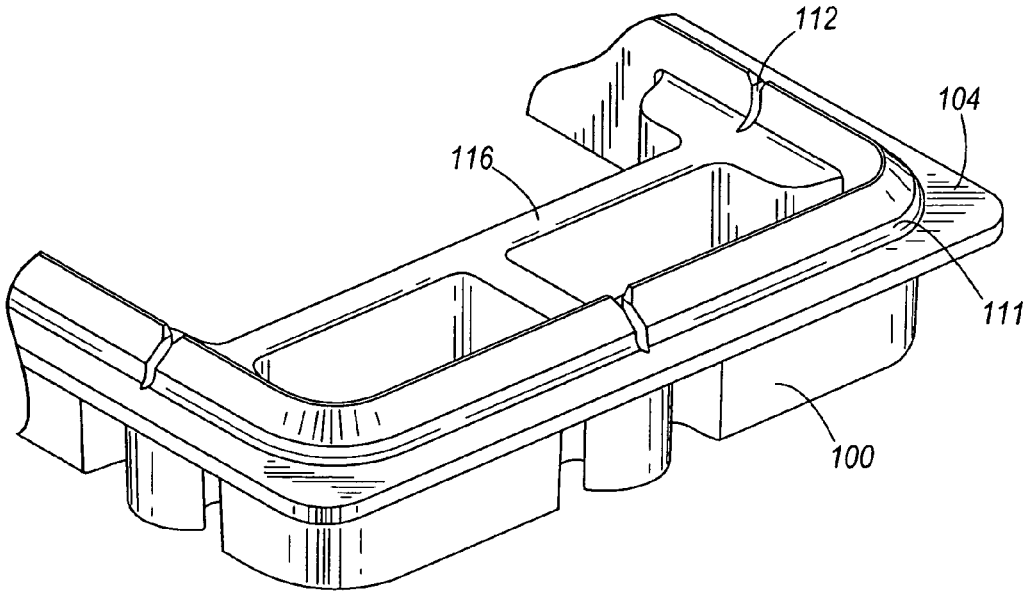
FIG. 3 is a detail view of the tank reinforcement member shown in FIGS. 1 and 2.
Figure 4:
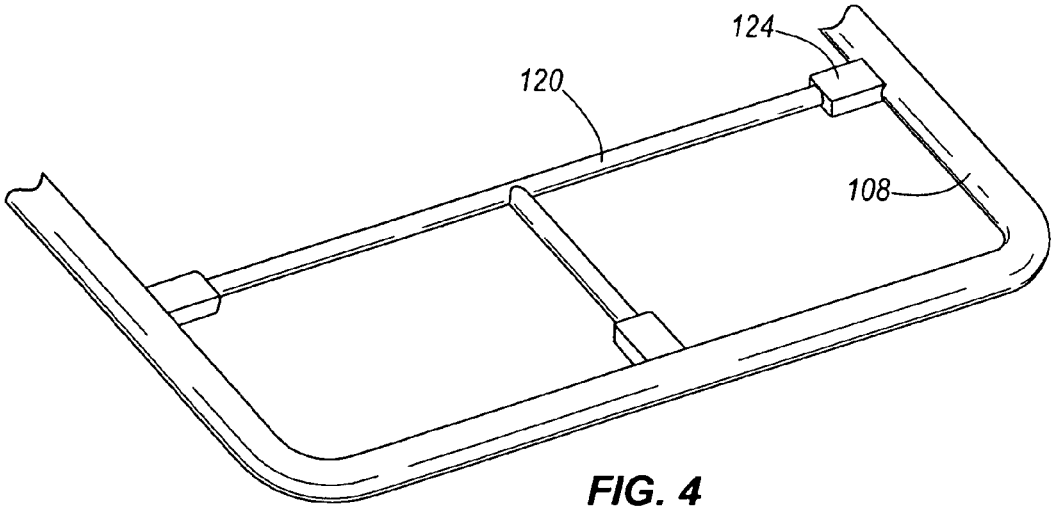
FIG. 4 is a detail view of the gasket shown in FIGS. 2 and 3.
Figure 5A:
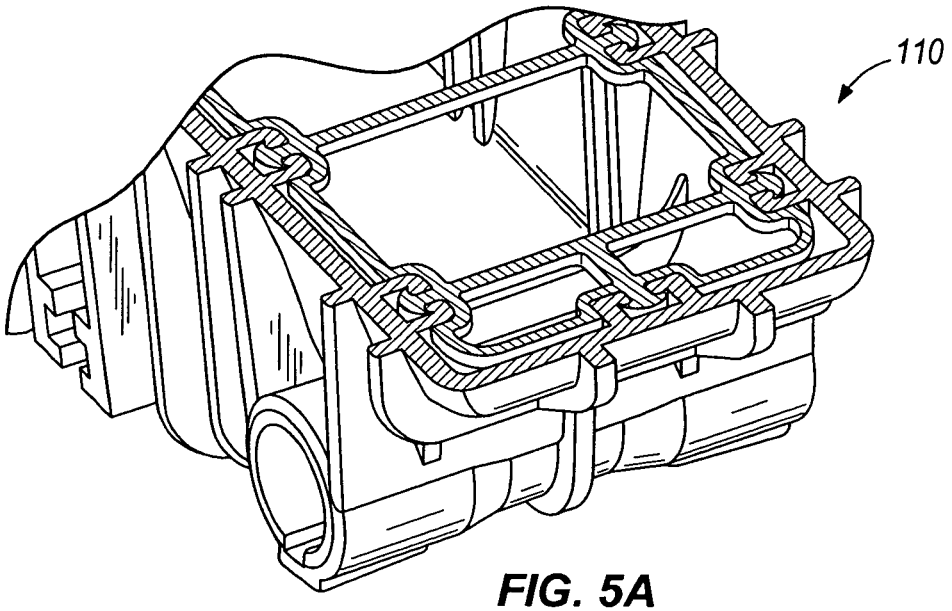
FIG. 5A is a cross-sectional view of the collection tank shown in FIG. 1, taken along line 5A-5A of FIG. 1.
Figure 5B:
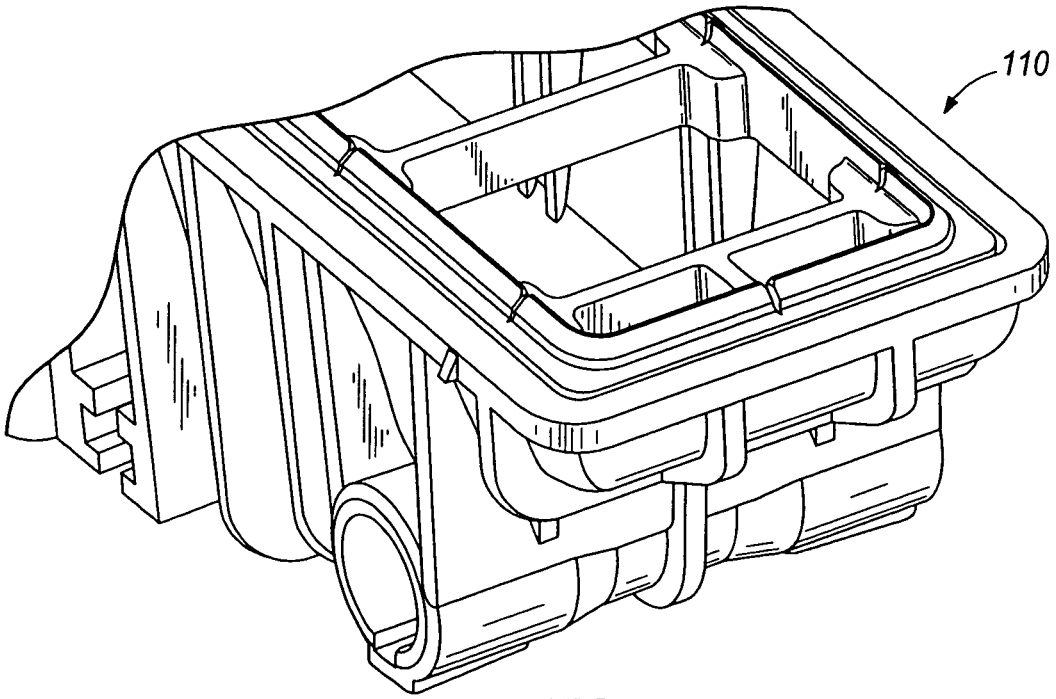
FIG. 5B is a perspective assembled view of the collection tank and the tank reinforcement member shown in FIGS. 1-3 and 5A.
Figure 6A:
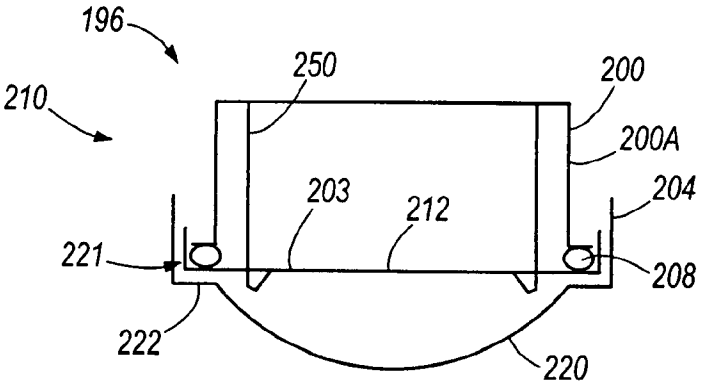
FIG. 6A is a schematic cross-sectional view of a collection tank, reinforcement member, and header according to an embodiment of the present invention.
Figure 6B:
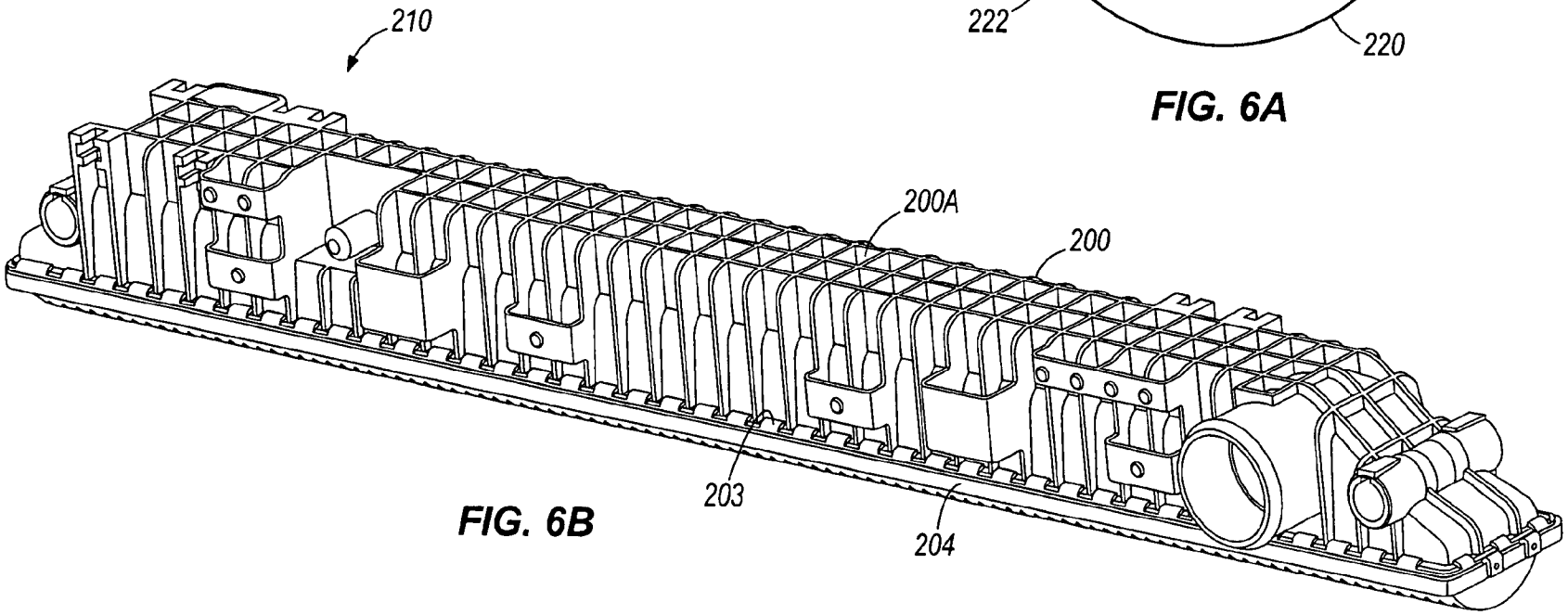
FIG. 6B is a perspective view of a collection tank assembly according to an embodiment of the present invention.
Figure 6C:
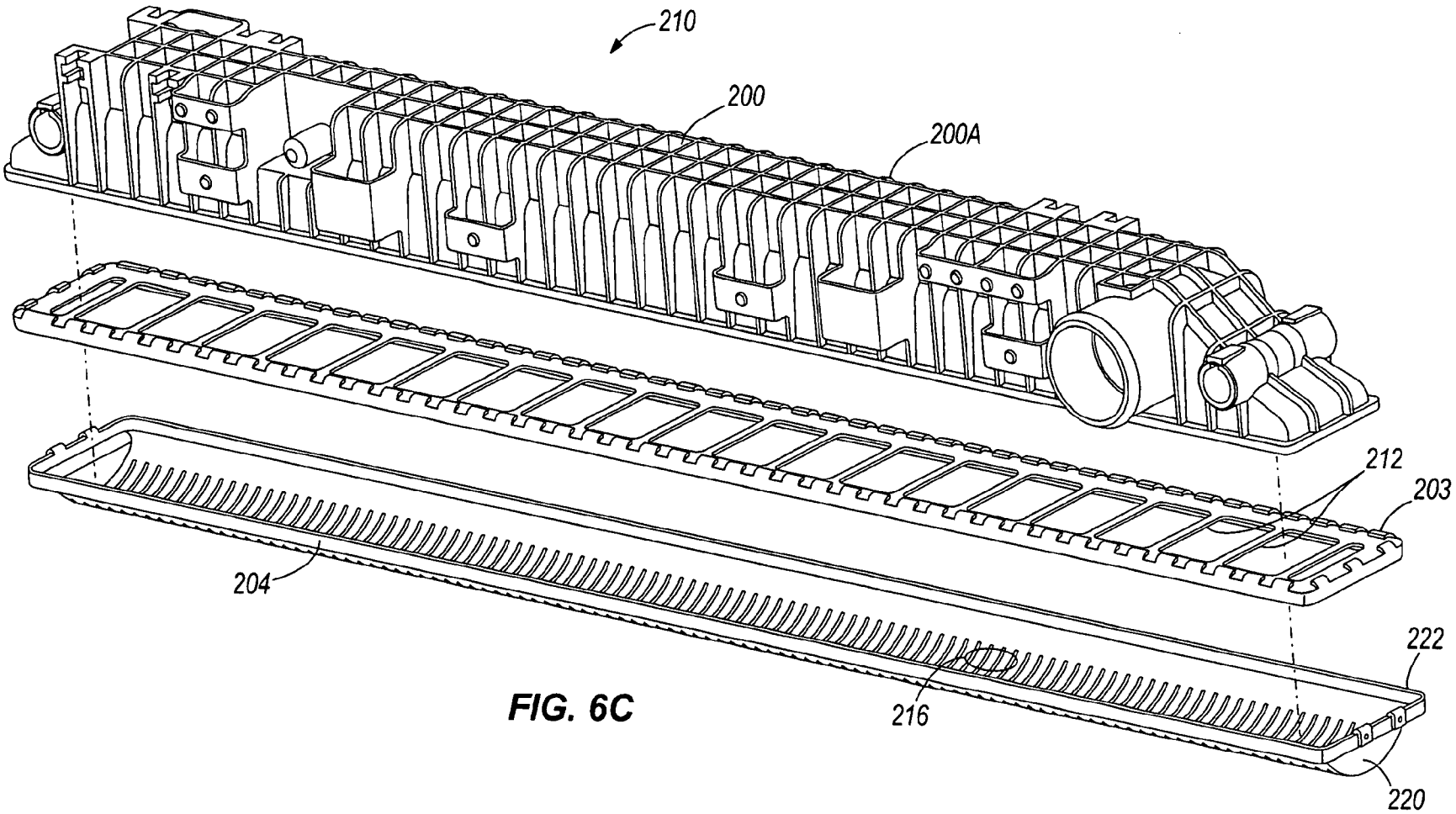
FIG. 6C is an exploded perspective view of the collection tank assembly shown in FIG. 6B.
Figure 6D:
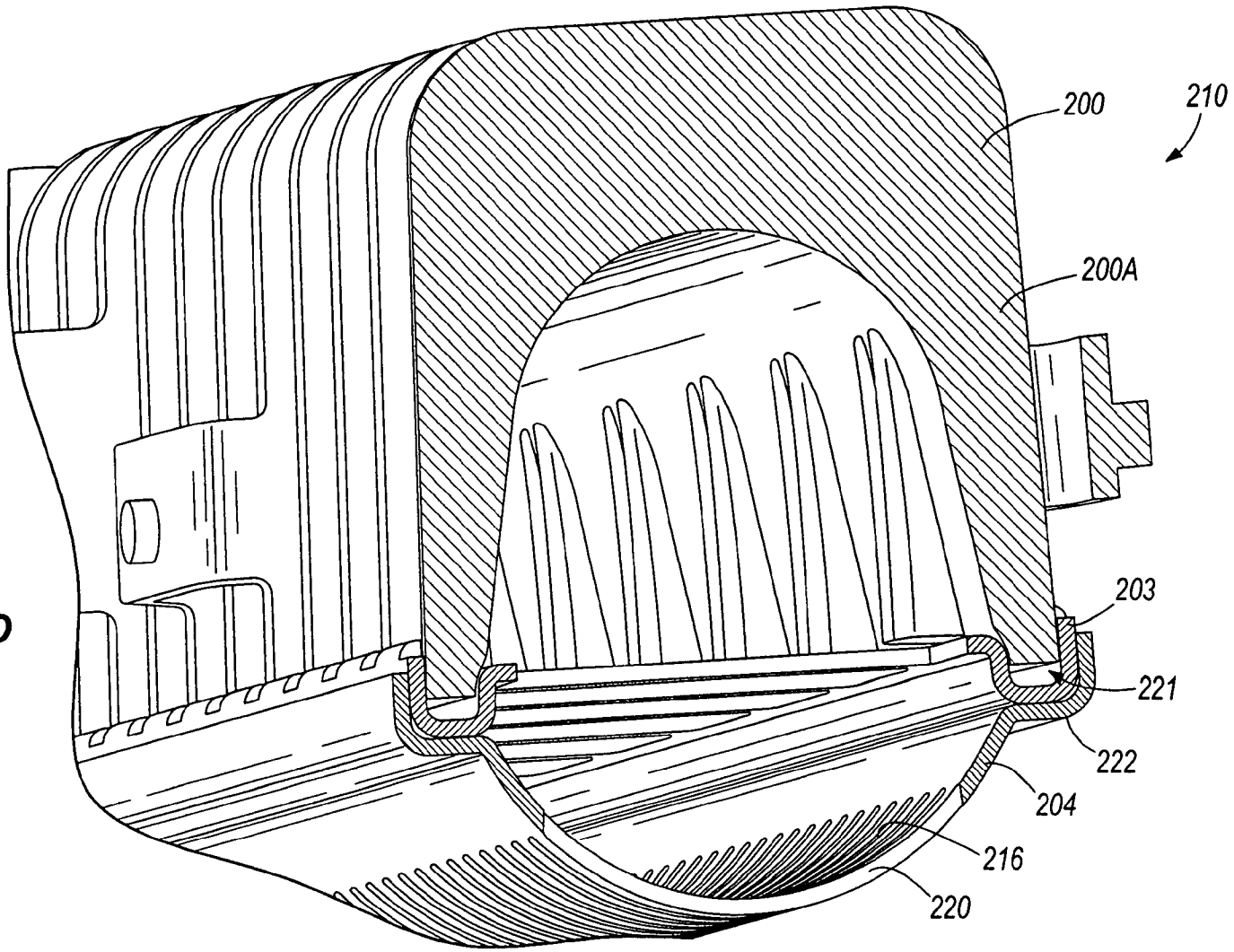
FIG. 6D is a detail view of the collection tank assembly shown in FIGS. 6B and 6C.
Figure 6E:
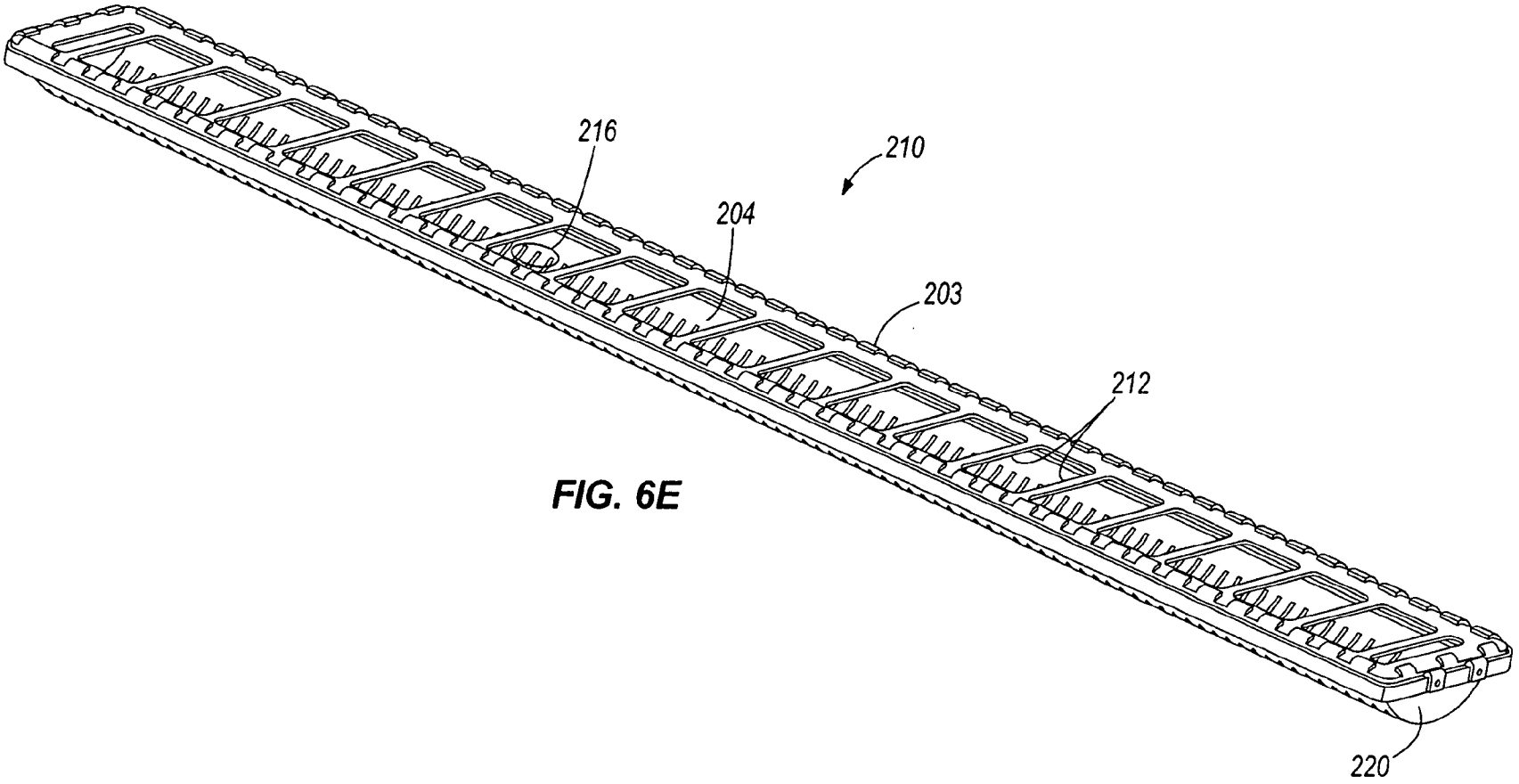
FIG. 6E is a perspective view of a part of the collection tank assembly shown in FIGS. 6B-6D.
Figure 6F:
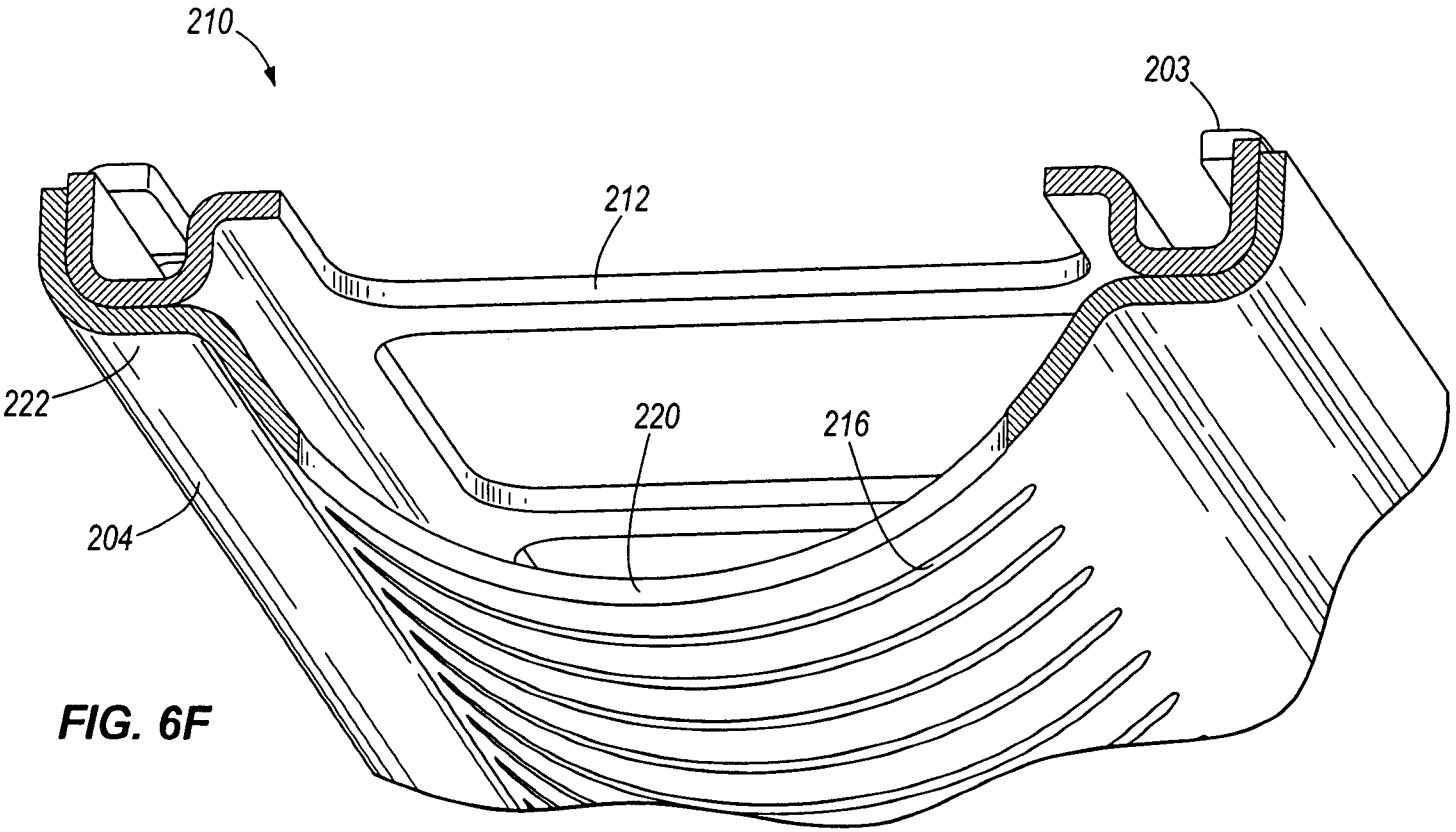
FIG. 6F is a cross-sectional perspective view of part of the collection tank assembly shown in FIGS. 6B-6E.
Figure 6G:
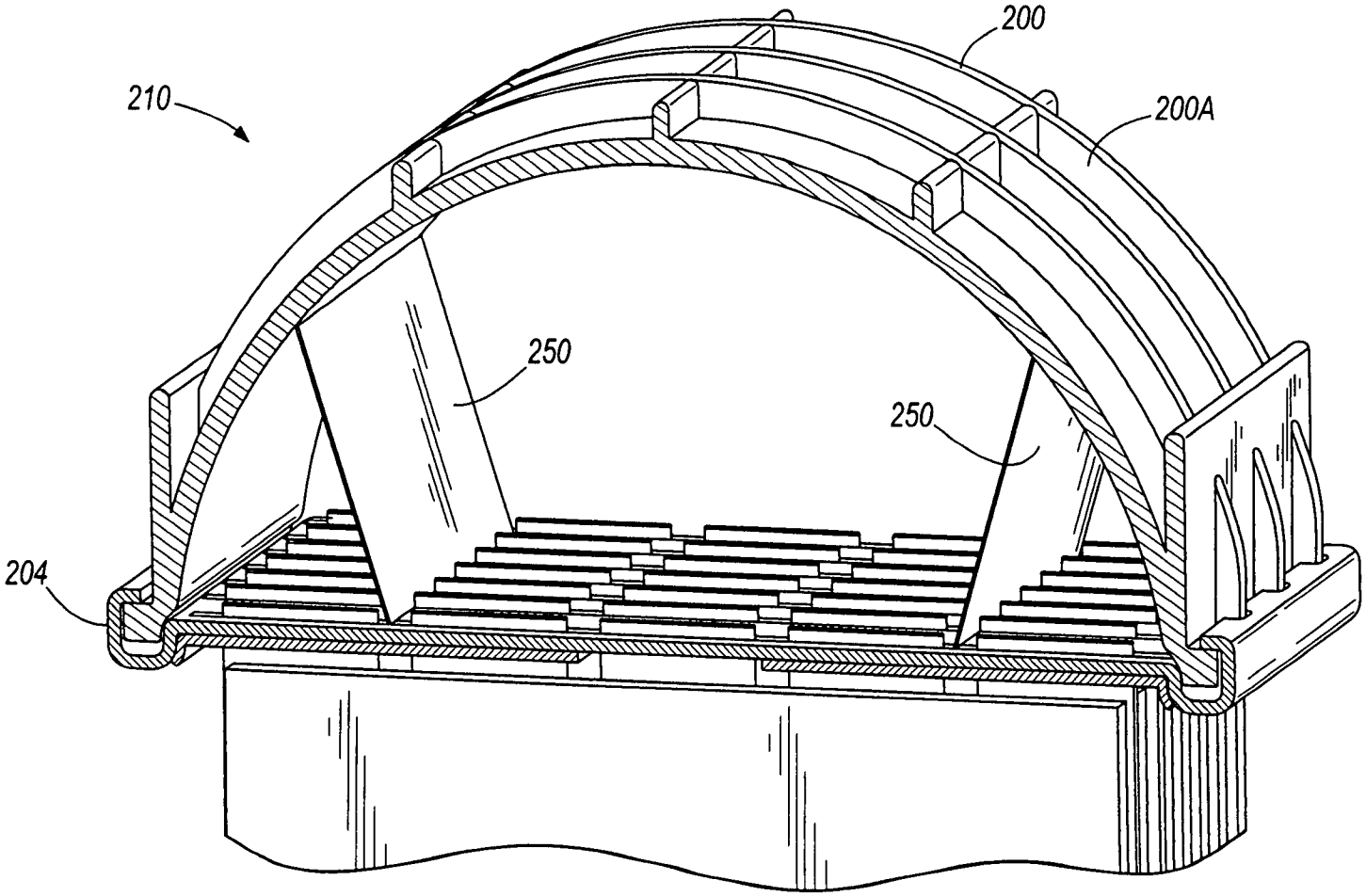
FIG. 6G is a cross-sectional perspective view of part of a heat exchanger according to another embodiment of the present invention.
Figure 6H:
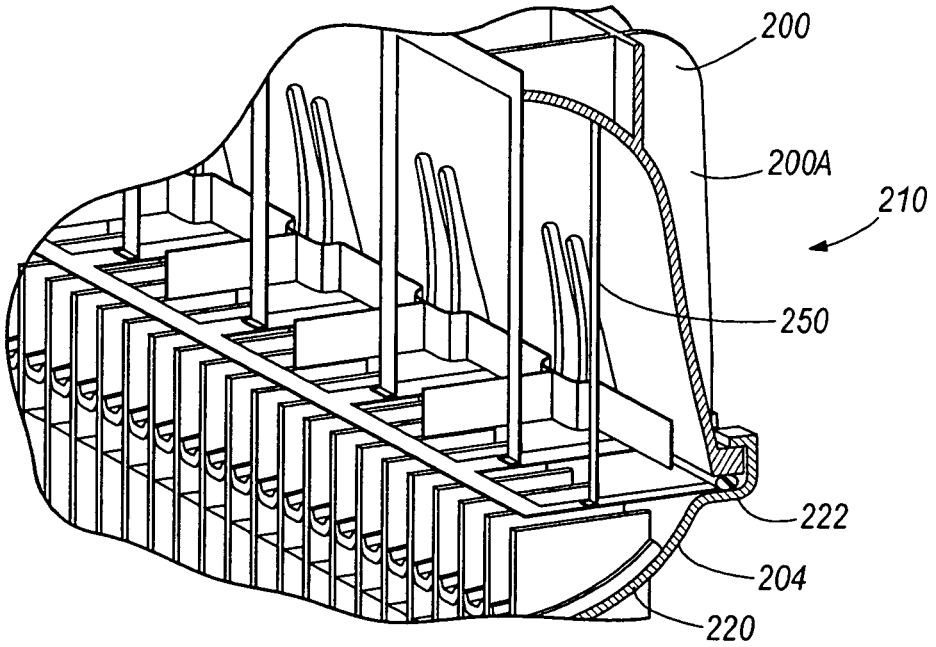
FIG. 6H is a cross-sectional perspective view of part of a heat exchanger according to another embodiment of the present invention.
Figure 6I:
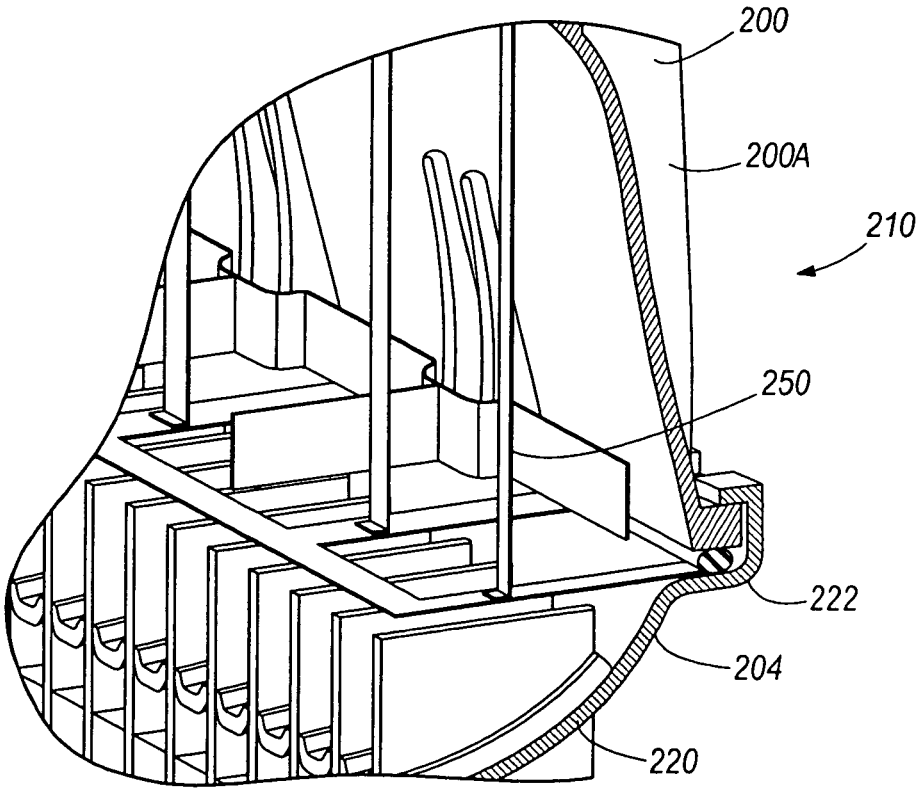
FIG. 6I is a cross-sectional perspective view of part of a heat exchanger according to another embodiment of the present invention.

Some embodiments of the present invention utilize additional collection tank strengthening elements alone or in conjunction with any of those described above (e.g., the tank reinforcing members 104, 203). FIGS. 6A and 6G-6I provide examples of such strengthening elements. With reference first to FIG. 6A, the collection tank 200 can be provided with one or more reinforcements 250 extending from one or more walls of the collection tank 200 to a position engaged with a tank reinforcement member 203 as shown schematically in FIG. 6A. These reinforcements 250 can have any shape desired, such as elongated fingers as shown in FIGS. 6A, 6H, and 6I, wider plates as shown schematically in FIG. 6G (in which case the reinforcements 250 can compartmentalize the interior of the collection tank 200, in some embodiments), and the like. Also, these reinforcements 250 can be integral with the collection tank 200 or can be separate elements permanently or releasably attached thereto in any manner. The reinforcements 250 can be positioned and oriented to engage the tank reinforcement member 203 so that flexure or other movement of the collection tank 200 can be limited. The reinforcements 250 can also be movable with respect to the tank reinforcement member 203 (e.g., by a sliding fit, one or more lost motion connections, and the like), thereby enabling force to be transmitted through the reinforcements 250 in one direction, but with no or limited ability for force transmission in an opposite or other direction. For example, it may be desirable for the reinforcements 250 to prevent outward bulging or flexure of a collection tank wall, while still permitting inward movement of the same wall, or to permit movement of one or more portions of the collection tank 200 (e.g., header flexure) responsive to varying heat exchanger tube expansion and contraction during operation of the heat exchanger. Although only two collection tank reinforcements 250 are shown in particular positions in FIGS. 6A and 6G, and a particular number of such reinforcements are visible in FIGS. 6H and 6I, it will be appreciated that any number of such reinforcements 250 extending across the interior of the collection tank 200 can be used, in many cases without disruption to flow within the collection tank 200.

Figure 13:
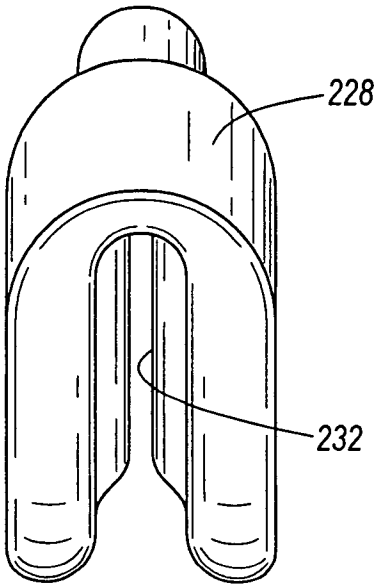
FIG. 13 is an end view of the grommet shown in FIG. 11.
Figure 12:
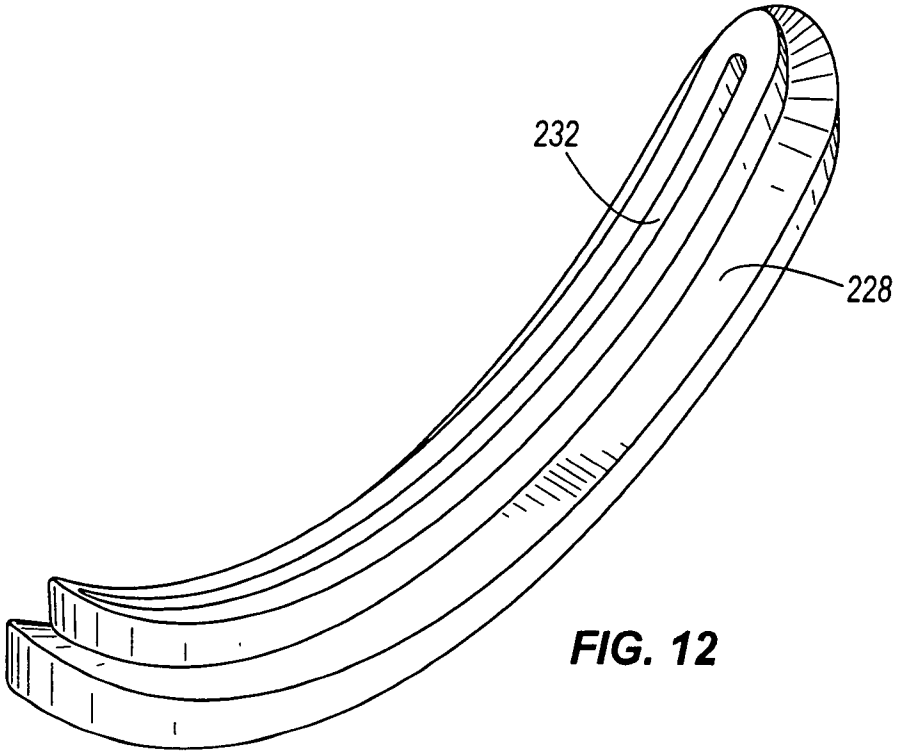
FIG. 12 is a perspective view of a grommet shown in FIG. 9.

FIGS. 9-13 illustrate heat exchangers utilizing various features according to some embodiments of the present invention. With reference to FIGS. 9, 10, 12, and 13, an option for any of the curved header heat exchangers described above is to utilize curved grommets 228. Such grommets 228 can be made from rubber, EPDM, or any other material suitable for providing a fluid-tight seal, and could be installed within the tube apertures of the header 204 or upon the ends of tubes being inserted within the tube apertures of the header 204. With particular reference to FIGS. 12 and 13, the illustrated grommet 228 has an opening 232 similar to the openings 216 in the header 204, and is also configured to receive a flat tube 224. The grommets 228 in the illustrated embodiment are shaped to provide an interference fit with the exterior of the flat tubes in order to prevent fluid leakage through the header-to-tube joints, while still allowing tubes experiencing thermal expansion and contraction to move as necessary. Regardless of the cause of tube movement, such grommets 228 can enable the tubes to move independently of one another and of the header 204 (by sliding within the grommets 228, in some cases). The grommet design can be used for plastic tank radiators, charge-air-coolers, all-aluminum tank and header designs, and a number of other heat exchanger applications.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

The invention claimed is:

1. A heat exchanger, comprising:

a plurality of tubes each having opposing broad and substantially flat sides joined by two opposing narrow sides;

a plastic collection tank having walls defining an internal chamber in fluid communication with the plurality of tubes;

a metal header coupled to the plastic collection tank and having a plurality of apertures each dimensioned to receive a corresponding tube of the plurality of tubes, the metal header elongated in a longitudinal direction and curved about a longitudinal axis of the metal header to present a concave shape to the internal chamber and a convex shape away from the internal chamber;

a gasket at least partially separating the metal header from the plastic collection tank and sealing a gap between the metal header and the plastic collection tank; and a tank reinforcement member coupled to the plastic collection tank and located within the internal chamber, the tank reinforcement member extending between the walls of the plastic collection tank and across the internal chamber, the tank reinforcement member at least partially retaining the gasket in position between the metal header and the plastic collection tank, wherein the tank reinforcement member includes apertures that receive the gasket to removably couple the gasket directly to the tank reinforcement member, and wherein the plastic collection tank includes a plurality of apertures within the internal chamber that each receive the tank reinforcement member to removably couple the tank reinforcement member and the gasket to the plastic collection tank.

2. The heat exchanger of claim 1, wherein the tank reinforcement member extends from one side of the internal chamber, across the internal chamber, and to an opposite side of the internal chamber.

3. The heat exchanger of claim 1, wherein the gasket is retained between a substantially flat shoulder of the plastic collection tank the tank reinforcement member.

4. The heat exchanger of claim 1, wherein the gasket has a cross-sectional shape and is received within a seat of the tank reinforcement member having a corresponding shape.

5. The heat exchanger of claim 1, wherein at least one portion of the gasket extends across the internal chamber.

6. The heat exchanger of claim 1, further comprising a grommet received on a tube of the plurality of tubes and curved about the longitudinal axis of the metal header.

7. A heat exchanger, comprising:

a plurality of tubes each having opposing broad and substantially flat sides joined by two opposing narrow sides;

a collection tank having walls defining an internal chamber in fluid communication with the plurality of tubes, the collection tank further including a substantially flat shoulder;

a header coupled to the collection tank and having a plurality of apertures each dimensioned to receive a corresponding tube of the plurality of tubes, the header elongated in a longitudinal direction and curved about a longitudinal axis of the header to present a concave shape to the internal chamber and a convex shape away from the internal chamber;

a gasket located between the substantially flat shoulder of collection tank and the header to provide a seal at an interface of the collection tank and the header; and a tank reinforcement member coupled to the collection tank between the header and the collection tank, the tank reinforcement member extending between the walls of the collection tank and across the internal chamber, wherein the gasket extends on a shoulder of the tank reinforcement member and onto the substantially flat shoulder of the collection tank, the substantially flat shoulder of the collection tank being flush with the shoulder of the tank reinforcement member, and wherein the gasket seals an interface between the substantially flat shoulder of the collection tank and the header, wherein the tank reinforcement member includes apertures that receive the gasket to removably couple the gasket directly to the tank reinforcement member, and wherein the collection tank includes a plurality of apertures within the internal chamber that each receive the tank reinforcement member to removably couple the tank reinforcement member and the gasket to the collection tank.

8. The heat exchanger of claim 7, wherein the header comprises one of metal and plastic, and the collection tank comprises one of plastic and metal, respectively.

* * * * *